US008907194B2

(12) United States Patent
David

(10) Patent No.: US 8,907,194 B2
(45) Date of Patent: Dec. 9, 2014

(54) SYSTEM FOR COMPUTER-ASSISTED INTERPRETATION OF PRE-RECORDED MUSIC

(75) Inventor: Dominique David, Claix (FR)

(73) Assignee: Movea, Grenoble (FR)

( * ) Notice: Subject to any disclaimer, the term of this patent is extended or adjusted under 35 U.S.C. 154(b) by 632 days.

(21) Appl. No.: 13/131,009

(22) PCT Filed: Nov. 24, 2008

(86) PCT No.: PCT/EP2008/066087

§ 371 (c)(1),
(2), (4) Date: May 24, 2011

(87) PCT Pub. No.: WO2010/057537

PCT Pub. Date: May 27, 2010

(65) Prior Publication Data

US 2011/0232462 A1 Sep. 29, 2011

(51) Int. Cl.

| | |
|---|---|
| ***A63H 5/00*** | (2006.01) |
| ***G04B 13/00*** | (2006.01) |
| ***G10H 7/00*** | (2006.01) |
| ***G10H 1/00*** | (2006.01) |
| ***G10H 1/40*** | (2006.01) |
| ***G10H 1/36*** | (2006.01) |

(52) U.S. Cl.

CPC ..... *G10H 1/0008* (2013.01); *G10H 1/0066* (2013.01); *G10H 1/40* (2013.01); *G10H 1/361* (2013.01)

USPC ..... 84/609

(58) Field of Classification Search

USPC ..... 84/477 R, 609, 649, 470 R

See application file for complete search history.

(56) References Cited

U.S. PATENT DOCUMENTS

| | | | | |
|---|---|---|---|---|
| 5,521,323 | A * | 5/1996 | Paulson et al. | 84/610 |
| 5,902,947 | A * | 5/1999 | Burton et al. | 84/477 R |
| 6,376,758 | B1 * | 4/2002 | Yamada et al. | 84/612 |
| 7,291,779 | B2 * | 11/2007 | Hasebe | 84/477 R |
| 8,076,564 | B2 * | 12/2011 | Applewhite | 84/477 R |
| 2001/0007219 | A1 | 7/2001 | Uehara | |
| 2004/0055441 | A1 * | 3/2004 | Katsuta | 84/470 R |
| 2005/0204901 | A1 | 9/2005 | Hasebe | |

FOREIGN PATENT DOCUMENTS

WO 98/58364 A 12/1998

OTHER PUBLICATIONS

International Search Report from PCT/EP2008/066087 issued Dec. 10, 2009.

Written Opinion from PCT/EP2008/066087 issued Dec. 10, 2009.

* cited by examiner

*Primary Examiner* — Jeffrey Donels

(74) *Attorney, Agent, or Firm* — Stroock & Stroock & Lavan LLP

(57) ABSTRACT

The invention relates to a computer-aided prerecorded-music-interpretation system. The system comprises at least one musical actuator (A1, A2) actuatable by an interpreting artist user, memory means for storing musical information (MM) relating to the score of a piece of music to be interpreted by the user, and means for transmitting the musical information to an electronic/computerized device (A4) adapted for producing audio signals on the basis of the musical information received. The memory (MM) for the musical information defines the totality of the musical events (EM) constituting the piece of music to be interpreted. The invention is usable in the field of prerecorded-music interpretation.

17 Claims, 4 Drawing Sheets

SYSTEM FOR COMPUTER-ASSISTED INTERPRETATION OF PRE-RECORDED MUSIC

This application is a national phase application under §371 of PCT/EP2008/066087, filed Nov. 24, 2008, the entire contents of which are expressly incorporated herein by reference.

TECHNICAL FIELD OF THE INVENTION

The invention relates to a computer-aided prerecorded-music-interpretation system, of the type essentially comprising at least one musical actuator actionable by an interpreting artist user, memory means for storing musical information relating to the score of a piece of music to be interpreted by the user and means for transmitting the musical information to an electronic/computerized device adapted for producing audio signals on the basis of the musical information received.

BACKGROUND OF THE INVENTION

It is known that the interpretation of pieces of music, for example from the classical repertoire, demands a mastery not possessed by the majority of those who would like to play these pieces. Computer-aided music-interpretation systems of the type stated above are already known, said systems allowing those insufficiently skilled at interpreting artists to tackle the interpretation of pieces of music which demand a high technical level. However, the known systems exhibit a major drawback of limiting the possibilities of customizing the music during the performance of a piece of music. In particular, musical information controlled by the performer by virtue of an actuator is limited in two ways. Only the triggering of musical notes is taken into account by the interpretation assistance system, and in a one-to-one manner for each actuator concerned. In fact, only one note or a group of notes may be played at a given instant. This does not permit, during play on the given actuator, for example the keyboard zone associated with the melody, the sustaining of notes while other notes are played, this nevertheless being a common situation.

Moreover, the stopping of the notes does not benefit from the control which would be useful to be perfectly faithful to the musical score. For example, the stopping of the notes is caused by a "stop" prompt by the performer. On the one hand, this does not permit the playing of multiple nested notes such as mentioned above; on the other hand, this does not make it possible to entrust the control of the stopping of notes to the system rather than to the user. Beyond the triggering and the stopping of notes in themselves, the interpretation of a piece requires other types of information in order to embellish the interpretation. It is possible to cite in this respect not only the use of the sustain pedal on keyboards, but also continuous controls, for example the volume variation of a wind instrument, the occurrence of a vibrato in the course of the life of the played note, or the evolution of timbre of an instrument from the brass family from a muffled sound to a bright and rich sound. The consideration of these sound evolutions requires continuous temporal control at any instant of all these parameters, that can be updated at any instant by the performer as a function of the desired interpretation. However, the known systems are not capable of meeting these demands.

SUMMARY OF THE INVENTION

The aim of various embodiments of the present invention is to propose a computer-aided prerecorded-music-interpretation system which alleviates the abovementioned drawbacks of the prior art systems.

To achieve this aim, the system according to embodiments of the invention comprises a first memory MM for the musical data, which defines the totality of the musical events EM constituting the piece of music to be interpreted.

According to embodiments of the invention, the system comprises a second memory MA for the sequence of actions that are necessary for the reproduction of the stored musical events EM.

According to embodiments of the invention, the first memory MM is structured in such a way that with each musical event EM to be reproduced there is associated a first time index designating the number of resolution increments existing between the start of the piece to be reproduced and this event, several musical events EM possibly being associated with a first time index.

According to embodiments of the invention, each musical event includes a series of a number of predetermined numerical values, relating notably to the assignment of the event EM to the corresponding actuator, to the execution of the event.

According to embodiments of the invention, the second memory MA contains, associated with second time indices for which a musical event EM exists, the list of the expected actions of the corresponding actuator as well as the way in which each of these actions should be processed.

According to embodiments of the invention, the second memory MA contains the number of the actuator that produced the action and the status of the action which might or might not be a synchronization action AS.

According to embodiments of the invention, the second memory MA comprises, associated with each second time index for which a musical event exists, for each actuator present in the system, the instant of the next synchronization action as well as information about the status of the expected action which can take three values respectively representative of the absence of an expected action, of a synchronization action AS and of a non-synchronizing action.

According to embodiments of the invention, the system comprises, in each track corresponding to an actuator, a time sequence generator GST, which is adapted to verify whether in the second memory MA an action is scheduled and, in the affirmative, whether this action is a simple action or a synchronizing action AS.

According to embodiments of the invention, the time sequence generator GST is configured to ignore an action originating from the actuator if no action was expected at this instant according to the memory MA, or, if a non-synchronizing action is expected, for causing the reading of the musical event in the first memory MM, and for making the audio synthesis unit AU play the event or, in the case where at this instant an action of synchronization type AS is present in the first memory MM, for determining by calculation the instantaneous speed of execution of the piece by the artist and the number of temporal resolution increments/steps until the next synchronization action expected according to the second memory MA and the generation of the sequence of time indices at a rate corresponding to the calculated speed.

According to embodiments of the invention, the system comprises a purge mechanism PU allowing the user to play certain musical events EM in a priority manner in case of a significant acceleration of his or her playing.

According to embodiments of the invention, the purge mechanism includes a track-based memory containing, at any instant, the musical events EM such as "note starts" or "pedal depression" and, for each initiated note or depressed pedal, an index indicating the scheduled end of this note or the pedal release.

According to embodiments of the invention, when the sequence of time indices normally reaches the event EM containing the stopping of a note stored in the purge memory, this event EM is played and the note is stopped and deleted/erased from the memory.

According to embodiments of the invention, the purge mechanism is adapted to be entirely scanned on receipt of any new action and when there are events EM, such as a note or a pedal, the time index of which is less than that of the action currently undergoing processing, the note is stopped or the pedal released and removed from the purge memory.

According to embodiments of the invention, the system comprises a mechanism for filtering a musical event EM when such an event must be played by the system either because an actuator has triggered this event or because a temporal sequence currently undergoing execution has caused it.

According to embodiments of the invention, the system comprises a filtering mechanism comprising a dedicated interface allowing the user to instigate a filtering.

BRIEF DESCRIPTION OF THE DRAWINGS

The invention will be better understood, and other aims, characteristics, details and advantages thereof will be more clearly apparent, in the course of the explanatory description which follows with reference to the appended schematic drawings given solely by way of example illustrating embodiments of the invention and in which.

DETAILED DESCRIPTION

Figure 1:
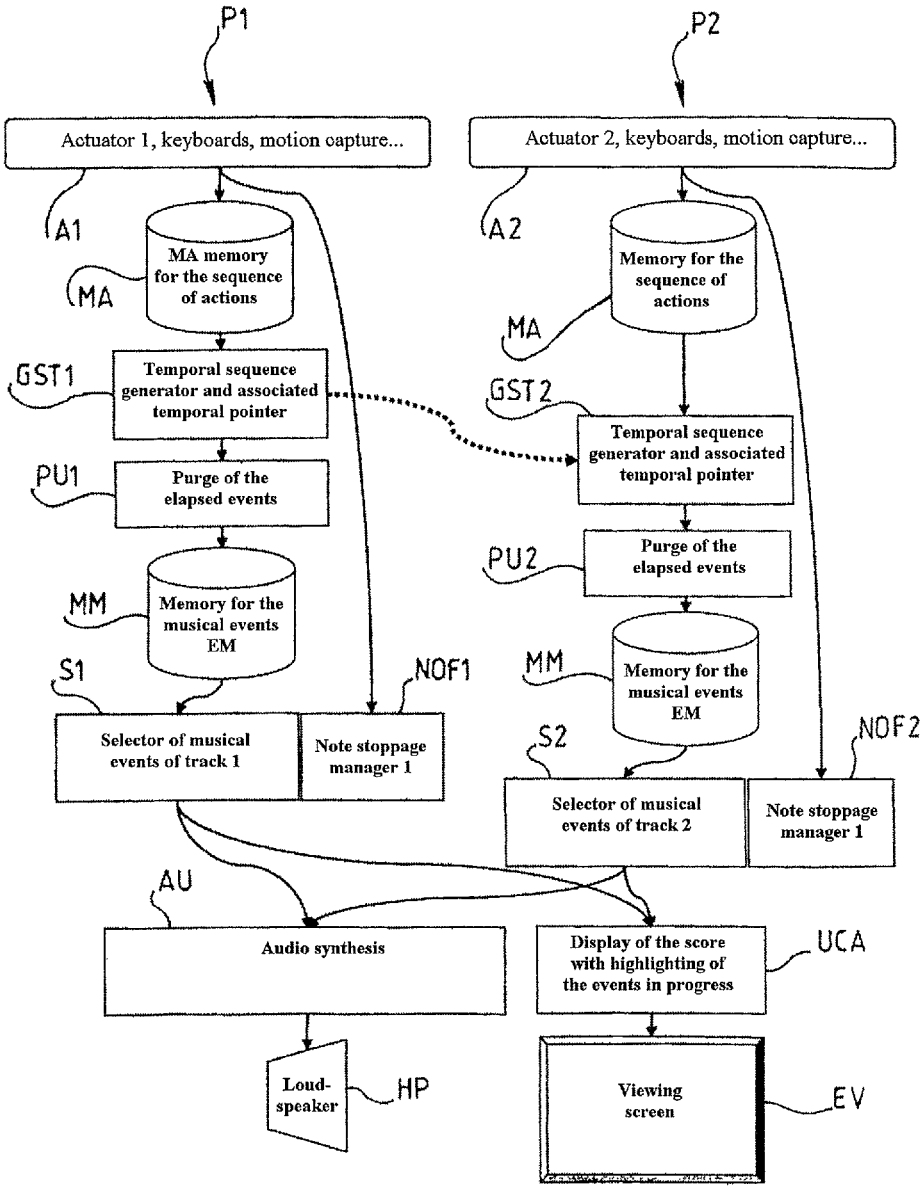
FIG. 1 represents, schematically, the system according to embodiments of the invention.

As shown by FIG. 1, a computer-aided prerecorded-music-interpretation system according to embodiments of the invention comprises at least one track, but in general, a plurality of tracks P of which two P1, P2, are represented, each comprising a musical actuator A1, A2, a memory MA for the sequence of actions that a user artist can perform, a temporal pointer PT (not represented) which determines, as a number of temporal resolution increments, where one is in the played piece, a generator of track-based temporal sequences GST1, GST2, a unit for purging the lapsed events denoted PU1, PU2, a memory for the musical data MM, a selector of events S1, S2, a track-based manager for stopping notes NOF1, NOF2, a sound synthesis and production unit AU and a unit for calculating and displaying common scores UCA. The memories MA and MM, the sound synthesis and production unit AU and the calculation and display unit UCA are common to the various tracks. The system furthermore comprises a loudspeaker HP and a viewing screen EV. The arrowed lines indicate actions of the various components of the system.

In some embodiments, musical actuators are instruments of the type known by the term MIDI (Musical Interface Digital Instruments), that is to say, instruments provided with a digital musical interface. Embodiments of the invention relate to MIDI musical actuators such as keyboards, systems for capturing movements on the basis of video or sensors producing information, either discrete such as notes present or absent, the pitch and the velocity of the notes, pedals actuated or not, and toggling between logic states, or continuous such as MIDI controls like volume, pressure, breath or the position/orientation of a movement, or both types of information.

The systems according to embodiments of the invention are based on the use of the MIDI communication and control protocol and of the MIDI standard allowing the exchange of data between electronic music instruments, one or more of which may be computers.

The MIDI standard is an international standard allowing electronic instruments from different manufacturers to communicate with one another. This standard relies, briefly, on sequences of 3 values, namely:

- a status code, lying between 128 and 255. The division of this code by 16 indicates the type of musical event, for example the digit 9 indicates a note triggering, 8 indicates a note stoppage, 11 a continuous control. The remainder of this same division indicates a MIDI channel between 1 and 16, allowing an apparatus configured to receive a given channel to retain only the events which relate to it;
- a value lying between 0 and 127, specifying the data related to the status hereinabove, for example—for a note triggering—the pitch of the note, the code 60 being allocated to the Middle C of keyboards with 88 keys, or else for a continuous control the type of controller, for example 7 for the volume, and 2 for the so-called breath control;
- a value lying between 0 and 127, for example the velocity of depression of the key in the case of a note triggering, which will determine the force with which the note will be played.

The MIDI standard is supplemented with a standard called MIDIFILE or MIDI file, defining a format for recording MIDI events. In particular, this standard envisages the notion of a track. The notion of MIDIFILE tracks is aimed at facilitating the organization of the data by the user. Different tracks are stored successively in a MIDI file, notwithstanding the manner of operation described hereinbelow.

The above-stated components of the system according to embodiments of the invention will be described hereinafter.

Memory for Musical Data MM

An important component of certain embodiments of the inventive system is the memory for the musical data MM that is shared by all the tracks. This memory contains the totality of the musical events EM constituting the piece to be interpreted. An event EM may be any event of the score of this piece, arising from the MIDI standard, notably notes of the score and a specific event of the system relating to the structure of the piece, such as for example a start of bar or an end of repetition, or an interpretation event such as an accentuated note, appoggiatura, arpeggio or trill.

The events EM are assigned to an actuator A1, A2 available to the user. The corresponding actuator number is encoded and forms part of the data designating the type of the event and is modifiable. This signifies that these events will be processed and played by the track corresponding to this actuator. There exist three types of association of an event with an actuator:

an event EM will be triggered only on receipt in due course of an actuation of the actuator concerned, performed by the artist using the instrument;

an event EM will be triggered as hereinabove, but this EM is, in addition, marked as being associated with a so-called synchronization action AS. An event of this type is for example a note of the score which is observed because it serves as temporal reference. The sequence of events AS makes it possible to estimate the user's playing speed. The time interval between two consecutive actions AS received from a given actuator is used for the calculation of the speed of execution of the pieces by the user;

an event EM will be played in an automatic manner and in due course by the track concerned without a user action being required.

It should be noted that it is possible to assign a "blank" event EM to an action. This EM is in all respects identical to the others, the only difference being that no audible action is triggered. It may be used on the other hand as associated with an AS. This possibility is especially useful for non-musicians who have not yet acquired a mastery of the exact rhythm of a piece.

Upon receipt by one of the tracks of a synchronization action AS, the temporal sequence generator of this track GST1, GST2 calculates the current instantaneous execution speed, and then generates a sequence of indices at the appropriate speed. This sequence is usable as input to the memory MM of the events EM which are then played as will be described further on in greater detail. The sequence stops in two possible ways:

either in the case of a slowing of the artist user's playing, because the sequence has reached a new event of AS type for which no action has been received. The system is then on standby;

or, in the case of an acceleration of the user's playing, because an action AS is received before it reaches a termination. The sequence is then interrupted and the events corresponding to the deleted time interval are processed.

An exemplary content of the memory MM is given in table 1 which follows and shows the format of the data in this memory.

TABLE 1

| | |
|---|---|
| 768 | 2145 43 127 1152 121 252 121 252 2145 59 127 1152 121 230 121 230 11144 62 127 1152 121 195 121 195 11144 67 127 1152 121 188 121 188; |
| 1152 | 1128 67 127 1152 121 188 121 188 1128 62 127 1152 121 195 121 195 2129 59 127 1152 121 230 121 230 2129 43 127 1152 121 252 121 252 2145 55 127 1536 151 234 151 234 2145 59 157 1536 151 229 151 229 11144 62 127 1536 151 194 151 194 11144 67 127 1920 151 187 151 187; |
| 1536 | 1128 62 127 1536 151 194 151 194 2129 59 127 1536 151 229 151 229 2129 55 127 1536 151 234 151 234 2145 52 127 1920 170 239 170 239 2145 60 127 1728 170 227 170 227 11144 64 127 1920 170 192 170 192; |
| 1728 | 2129 90 127 1728 170 227 170 227 2145 59 127 1920 183 229 183 229; |

It is noted that the structure of the data is organized as a table of rows, each row being accessible on the basis of its temporal index indicated in the left column. The temporal index of an event designates the number of resolution increments existing between the start of the piece and this event. Indeed, the time is measured by the system by the number of temporal resolution increments that have elapsed since the start of the piece. For example, musical data are often coded temporally with a temporal resolution of 384 increments per crotchet. In this case, the increment will equal $1/384^{th}$ of a second if the tempo is 60 crotchets per second. If the temporal pointer PT equals 1536, 4 seconds have elapsed.

There is therefore a row in the table for each temporal index where a musical event exists for the piece considered. Each row contains one or more musical events EM. Each musical event is itself made up of a series of 8 numerical values, namely:

type of the event: this is an extension of the MIDI standard. This standard defines the type of the event such as note-on (start of note), note-off (end of note), change of command, change of program. The numerical value of the type simultaneously codes a channel from among the sixteen MIDI channels, thus making it possible to define sixteen sound production pathways. The MIDI type is conveyed by an integer number lying between 128 and 225. According to the invention a coding prefix is added thereto;

the actuator track to which the event is allocated. For example, the actuator number multiplied by 1,000 is added to the MIDI type.

the AS or non-AS nature of the action associated with this event. For example, 10,000 is added to the MIDI type.

second customary datum, for example the pitch for a note;

third MIDI datum, for example the velocity;

temporal index of the end of the event, for example note-off for a note, or pedal-off for a pedal information cue. This information is used for the purge mechanism PU;

$X_{min}$ of the rectangle framing the event on the score;

$Y_{min}$ of the rectangle framing the event on the score;

$X_{max}$ of the rectangle framing the event on the score;

$Y_{max}$ of the rectangle framing the event on the score.

To facilitate the reading of the table, the first row relating to the temporal index 768 is explained hereinafter. A temporal resolution of 384 increments per crotchet indicates that we are in the second beat of the piece. The row contains 32 values and therefore defines four musical events EM, since each event is coded by 8 values. The first 8 values going from 2145 to 252 relate to a first EM. The first value 2145 makes it possible to ascertain the type of event, that is to say synchronization AS or not. As was indicated above, the division of the first value 2145 by 10,000 gives the type of event. The result of the division being 0, it is not a synchronization event AS. Division by 1000 gives 2, thus signifying that it is an EM relating to track 2. The remainder of the division by 1000 gives 145, hence it emerges that the event EM is allocated according to the MIDI codes to MIDI channel No. 2. The second and third values of the row, namely the values 43 and 127, designate respectively the pitch, 43 being flat, and the playing force, 127 being the maximum possible. The fourth value 1152 indicates the duration, which is 1152 resolution increments, that is to say four crotchets. This note is therefore a whole note. The four values which follow make it possible to position the event on the score, that is to say it gives the indications $X_{min}$, $Y_{min}$, $X_{max}$, $Y_{max}$.

The second EM going from 2145 to 230, analyzed in the above manner, is also not a synchronization event.

On the other hand, the third EM defined by the third group of 8 values going from 11144 to 195 is a synchronization event since dividing the value 11144 by 1000 gives 1. Division of 1144, namely the remainder of the division by 10000, by 1000 gives 1, thus signifying that this synchronization event AS relates to track 1. The remainder 144 indicates that it is, according to the MIDI codes, a note start to be allocated to MIDI channel 1.

The fourth EM beginning with the value 11144 is a synchronization event AS relating to track 1. It is a note start allocated to MIDI channel 1.

After the interpretation of the four musical events EM of the row of temporary index 768, it is necessary to decide whether or not to play them. This function is accomplished by a filtering mechanism which affords the user varied possibilities. These possibilities will be described, by way of example, further on. Briefly, if the user uses two actuators, for example the right hand and the left hand, and if the reading of the row of temporary index 768 has been performed subsequent to an action on the actuator A1, then only the EMs whose tracks are 1 will be played, namely the third and fourth EMs. If the reading relates to the list assigned to actuator A2, then only the first and second EMs are played. If the user uses only actuator A1, the filter lets through the events of track 2 which are then played in automatic manner synchronous with play on A1.

Memory for the Sequence of Actions MA

The memory MA for the sequence of actions constitutes another important and innovative characteristic of embodiments of the invention. This memory is important to embodiments of the invention since it contains, associated with each time increment concerned, the list of expected actions originating from each controller as well as the way in which each of these actions should be processed. The processing in question depends essentially on two factors, namely the number of the actuator that produced the action and the status of the action which might or might not be a synchronization action AS. At each temporal index for which a musical event EM exists, the memory MA contains, for each actuator present in the system, the instant of the next action of the type AS as well as the status of the expected action which can take three values:

- no expected action of this actuator at the instant considered;
- action of type AS expected;
- non-AS action expected.

When an action is received from an actuator A1, A2, the temporal sequence generator GST1, GST2 associated with the track of which the actuator forms a part verifies whether in the memory MA an action is scheduled and, in the affirmative, whether this action is a simple action or a synchronizing action AS. The generator GST1, GST2 performs the following operations:

- if no action was expected at this instant according to the memory MA, the action is ignored;
- if a simple action, that is to say a non-AS action, is expected, the musical event is read in the memory MM of the musical events EM, played by the audio synthesis unit AU and displayed on the screen if necessary;
- if the action is received whereas an action of AS-type action is present for this instant in the memory MM, the sequence of the following operations is triggered:
- calculation of the instantaneous speed VI of execution by the interpreting artist on the basis of the ratio of the actual temporal difference between the present action and the previous action received on the same actuator divided by the temporal difference in terms of resolution increments of musical data of the musical events triggered by the two actions. By way of example, if the note stored at the temporal index 1152 has been played on an action logged at the instant t1 and if the current action which takes place at t2 triggers a note stored at the index 2304, the instantaneous speed corresponds to a temporal resolution increment whose duration is [t2−t1)/(2304−1152)]. Stated otherwise, the duration in time of a temporal resolution increment is calculated.
- calculation of the scheduled number of increments NP until the next action of type AS expected according to the memory MA, obtained through the difference between the current temporal index and the temporal index of the next event AS, stored in MA.
- the reader pointer PLMA1, PLMA2 of the action memory MA is incremented so as to point to the next expected action of the actuator A1, A2. It should be noted that each generator GST1, GST2 preferably keeps a pointer PLMA up to date.
- triggering of the purge mechanism PU1, PU2 for the obsolete events, as will be explained further on.
- generation of the rhythmic sequence of temporal indices PT, PT+1, PT+2 up to PT+NP, at a rate corresponding to the calculated speed.

As a function of the sequence thus generated, the memory MM for the events EM is interrogated. If at this increment nothing is stored in the memory MM, nothing is done. If musical events are stored, they are provided by the memory MM in the form of a list of musical events EM. This list is filtered so as to utilize for the audible and visual rendition only some of the events that it contains, thereby offering total flexibility of execution through multiple choices of adaptation of the system, in particular:

- as was explained above, each musical event EM contains a value called a marker which indicates by which actuator it must be triggered. It is played only if its marker corresponds to the actuator which has triggered the processing currently in progress, otherwise it is not played.
- it is possible to choose to ask the system, for example, to filter the information regarding stopping of notes which must therefore then be played by the user with the help of the actuator, or conversely not to filter it so that the system takes charge of stopping the notes at the exact instants stored in the memory MM.
- it is possible to choose to filter the volume information, for example control 7 of the MIDI standard, or information regarding changes of sounds such as the program known by the term "program change" of the MIDI standard.

The events retained are dispatched, on the one hand, to the sound generator, and, on the other hand, to the unit for displaying the score on the screen.

In the case where at a given temporal index the memory MM contains an audio sequence (WAV file, AIFF, etc.), two cases are possible. Either the file is read as is, or it is read with a method of conventional temporal stretching/compression set to the speed VI. The choice of one of the two options to be applied is integrated into the event in the memory MM.

To summarize, when a synchronization action AS is received from an actuator A1, A2, the sequence of temporal indices going from the index corresponding to the action AS received up to the index of the next action AS is generated at a speed determined on the basis of the last two ASs received.

Two cases then arise:

- either the sequence proceeds to its termination before the system receives the action of the user which corresponds to the following synchronization action. This signifies that the performer user has slowed down. When the sequence, in this case, has arrived at its termination, nothing more happens on the track considered as long as the action of the user has not happened;
- or a new action of the user arises although the sequence has not finished. This signifies that the user is accelerating. In this case, the purge unit PU of the track concerned intervenes. Indeed, on the occurrence of the new action of the user, which corresponds to a synchronization action AS in the memory MM, the index of the sequence generator which, at this instant of time, has not yet reached the index of the action AS in the memory "skips" this index. In particular, if note stoppage events are stored at some of the intermediate temporal indices skipped, it is necessary to ensure that the system stops these notes correctly. To this end all the notes generated on a track, which have not finished, are stored in a temporary memory, which is the purge memory PU, accompanied by the index of the end of the note considered. The purge memory is read entirely and selects the notes in progress whose end is expected at one of the skipped indices, and then dispatches the corresponding note stoppage commands to the sound synthesis unit AU. The above explanation describes the operation of the purge memory PU on a note stoppage, but applies equally well to a pedal release event for example.

The manner in which the actuator number is taken into account in the processing of the action data stored in the memory MA is explained hereinafter. As has been written, each track-based temporal sequence generator GST keeps an up to date a pointer PLMA to the memory MA. This is necessary so that the user can gradually "progress" the data triggered successively by the actuator considered. In the case where more than one actuator is used, there is thus a risk of considerable shift between the various pointers PLMA, that may result in the loss of the overall coherence of the piece. A hierarchical level is therefore allocated to each actuator, from the highest, for example actuator 1, to the lowest. Each time a synchronization action AS is processed, the pointers PLMA of a lower priority are forced to the new value resulting from the processing of the synchronization action. In particular, any action of type AS on the highest actuator is imposed on the pointer of all the other actuators. This characteristic is symbolized in FIG. 1 by a dotted arrow going from GST1 to GST2.

After this general description of the action memory MA, table 2 which follows gives, by way of example, the structure of the data in an embodiment of this memory.

TABLE 2

| | |
|---|---|
| 1152 | 1 1536 1 1344 0 21120 1 1 0; |
| 1344 | 1 1536 1 1536 0 21120 1 1 0; |
| 1536 | 1 1920 1 1920 0 21120 1 1 1; |
| 1920 | 1 2304 2 2112 0 21120 1 1 1; |

It is noted that at each temporal index, in the left column, for which a musical event EM exists in the piece considered, the memory MA contains:

- as many pairs of values as actuators used. The first value indicates by a value 0, 1 or 2 the way in which it is necessary to process the action for this index and this actuator, 0 signifying no action, 1 a triggering action but without synchronization, and 2 a synchronization triggering action AS with updating of the speed VI;
- the second value of the pair is the temporal index of the next expected action on this actuator.

Hereinabove there lastly follow three numerical values indicating respectively the location of the event EM on the score displayed on the screen in terms of page number, system number, bar number.

For a more detailed understanding of the format of the data in the memory MA, the last row of the table, namely of temporal index 1920, will be commented on hereinafter.

The last three values define the location on the score.

The first pair of values 1 2304 always relates to track 1. The value 1 indicates that at the time increment considered, 1920, there exist on track 1 musical data to be played, which are not synchronization events. The second value 2304 of the pair indicates the temporal index of the next event EM existing on the track considered, therefore of the next EM allocated to the actuator A1.

The second pair of values 2 2112 always relates to track 2 to which the actuator 2 belongs. The value 2 of the pair indicates that to the actuation by the user of an action on A2 there corresponds a synchronization event ME and that it is necessary to resynchronize the progressing of this track on receipt of the user action. The system will therefore calculate, in the manner described above, the speed VI and generate a sequence of temporal indices at this speed until the next synchronization event EM existing on this track, which is precisely the second value of the pair, that is to say the value 2112.

The third pair of values, here 0 21120, always relates to track 3. The value 0 indicates that nothing needs to be done on the track. The value 21120 which follows indicates the next temporal index where a musical event EM to be played on track 3 is found. If the user has only two actuators then this value is fixed and equal to the temporal index for the end of the piece, that is to say the temporal index of the last event, in general stoppage of the last note.

Filtering Mechanism and Purge Mechanism

The system according to embodiments of the invention furthermore comprises a filtering mechanism and a purge mechanism which allows the system to offer the user the flexibility which will be apparent during the description of the general manner of operation of embodiments of the system and of the description of certain specific examples.

The aim of the filtering mechanism is to allow the user to configure the system as a function of his own desires, on the one hand, and to benefit from the flexibility offered, on the other hand.

The filtering of a musical event EM takes place each time such an EM must be played by the system, either because an actuator has triggered this EM, or because a temporal sequence currently undergoing execution has caused it.

The user can instigate a filtering by virtue of a dedicated interface. The user can choose filterings that may optionally differ for each track. Thus, the user may desire a single actuator A1 and therefore selects a mode of operation such as "used only actuator A1" or "plays only the right hand". Another choice can concern the management of the stoppages of notes that the user decides to perform himself or to entrust to the system. Finally, these choices could also be stored in the memory MM for the events EM and would then be detected during the reading of the event EM by a particular code, for example a negative numerical header for the first of the 8 values of each event EM, and indicated "on the fly" a given filtering mode. Thus the user can vary the play that he desires in the actual course of play.

During the playing of an event, the type of the event is extracted from the memory, in general from the first of the 8 values of a row of the memory MM and contrasted with the current filtering parameter for the track of the actuator concerned. For example, if the user has chosen to use two actuators A1 and A2, an event allocated to A2 will not be played when it is associated with track 1. If the user has chosen to make the system play the EMs of track 2, the filtering could be done in such a way that it is on the contrary played by track 1. The filtering can also be applied to the events of stoppage of notes of the MIDI codes 128 to 143. When this code is encountered, the corresponding event EM will be played only if the user has entrusted the note stoppages to the system. Otherwise it is ignored. According to another example, the object of certain events EM may be to change the sound restitution timbre used, in accordance with the MIDI codes 192 to 207, termed "program change" codes, so as, for example, to switch from a piano to a harpsichord. The user can ask the system not to play the events EM of this "program change" type when they are encountered and to ignore them. The timbre will therefore not change.

The purge mechanism is envisaged for some subsequent situations. As was explained above, after an action of the user on a given actuator, a sequence of temporal indices is generated with the aim of making the system play the events EM in an autonomous manner. The speed at which these events are played is deduced from the speed VI of the user by extrapolation of his play speed between his two more recent actions on a given actuator. The system obviously cannot foresee a significant change of speed on the part of the user. This does not pose any problem if the user slows down. If, on the other hand, he accelerates considerably, it is possible that the following action on his part may occur before the sequence in progress has reached its termination. This may pose a problem for certain types of events EM, including for example note stoppages: if a note has been initiated by the index sequence, but the latter is interrupted by the following action originating from an actuator, the event EM corresponding to the stopping of this note will not be played since the temporal index will "skip" to the value corresponding to the new action. Moreover, also potentially problematic are certain types of control, in particular the message "pedal on" corresponds to the depression of a piano pedal and the message of release not played on account of the acceleration. All the notes in progress will then be maintained permanently.

The purge mechanism is designed to avoid these situations. It makes it possible to be able to play certain events in a priority manner in the case of significant acceleration. In an embodiment, the purge mechanism is provided by, essentially, a track-based memory containing, at any instant, the events liable to cause a problem, in particular note stoppages and pedal, and which have been initiated, that is to say note starts or pedal depression played. Each time a note is initiated or the pedal depressed, the corresponding event EM is stored in the purge memory, with an index indicating the scheduled end of this note or the pedal release.

If the index sequence reaches normally the event EM containing the stopping of a note stored in the purge memory, then this EM is played, the note stopped and this note is deleted from the purge memory.

Finally, on receipt of any new action, the corresponding purge memory is entirely scanned. If the system finds EMs therein, for example a note or a pedal whose index is less than that of the action currently undergoing processing, then the note is stopped or the pedal released, and removed from the purge memory. Otherwise nothing is done.

Manner of Operation of the System According to Embodiments of the Invention

The general manner of operation of the system according to embodiments of the invention will firstly be described hereinafter while referring to FIG. 2, which illustrates the sequence of processings performed in a track n of the system subsequent to the receipt of an action triggered by the user, this action possibly being a simple action or a synchronization action. Thereafter the manner of operation will be set forth in greater detail with the aid of a few examples.

In addition to what is represented in FIG. 1, each track may be provided with a time window function which is managed by the unit. As was explained above, on receipt of an action by the user, which corresponds to a synchronization event AS on this track, the instant of appearance of this next synchronization action by the user is determined by establishing by calculation the current instantaneous speed VI up till the temporal index of this next synchronization action. A window with an opening whose duration may be fixed, but will for example be a percentage of the time interval between the current action AS and the next action AS, is placed around the calculated instant of appearance. If the window is activated, the next action received will be taken into account only if it takes place inside the calculated window. This window makes it possible to eliminate untimely user actions. In particular, it becomes possible for the inexperienced user to interpret a piece by triggering actions rhythmically for example at the desired speed and force, thereby imparting an already appreciable level of expressivity. Execution would then be correct.

Figure 2:
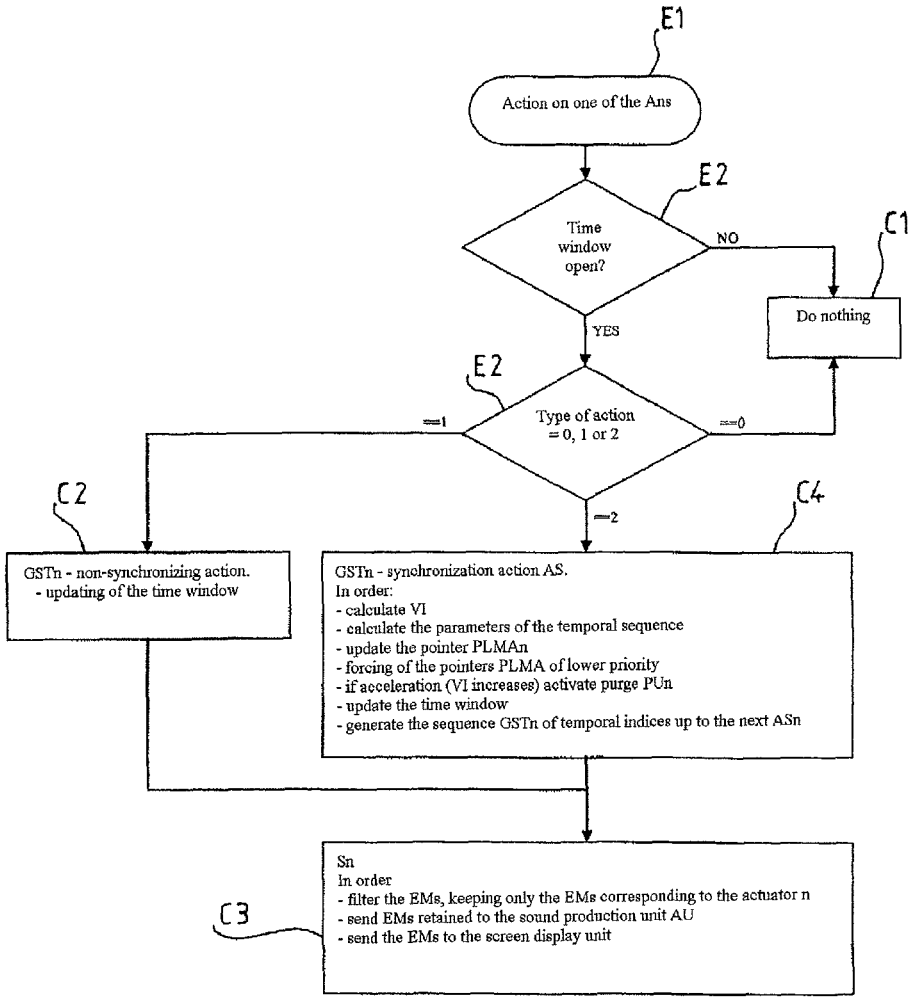
FIG. 2 illustrates, in the form of a flowchart, the operation of the system according to embodiments of the invention.

Referring to FIG. 2, it is noted that for systems according to certain embodiments of the invention, subsequent to an action of the user on an actuator A belonging to a track P constituting in FIG. 2 a first step E1 of the method, such system can verify in a method step E2 whether this action occurs at an instant of time which is situated inside the time window placed around the calculated instant of appearance of this action in the action memory MA. If at the moment of the user's action the window is not open, the system does nothing, as is indicated by the box C1.

In the affirmative, step E3 determines, by interrogating the action memory MA, whether at this temporal index an action is scheduled in the memory and the status of said action. The absence of an action causes a value 0 which does not give rise to any response. If an action of synchronizing action type is scheduled, the action involved is of value 2 and if the action is not synchronizing, the value 1 is allocated to it.

Subsequent to the noting of the presence of a non-synchronizing action, that is to say of the value 1 in the memory MA, the temporal sequence generator of the track of the actuator GST causes the reading at the corresponding time index of the musical event EM in the musical memory MM, makes the audio synthesis unit play this event and causes the event to be displayed on the screen if necessary. The execution of these operations is illustrated by boxes C2 and C3. If the action identified in the memory MA is a synchronization action AS, that is to say of value 2, the temporal sequence generator GST performs the following operations in box C4 in the indicated order, namely the calculation of the instantaneous speed VI of execution by the user, the calculation of the parameters of the temporal sequence, the updating of the pointer PLMA of the track of the actuator actuated by the user, the forcing of the pointers PLMA of lower priority, the activation of the purge memory PU in the case of the noting of an increase in the speed VI and thus of an acceleration, the updating of the time window and the generation of the sequence GST of the temporal indices until the next action of type AS. Next the musical event in the musical event memory MM at the corresponding temporal index is read and dispatched to the sound production unit AU and, if appropriate, to the on-screen display unit.

Figure 3:
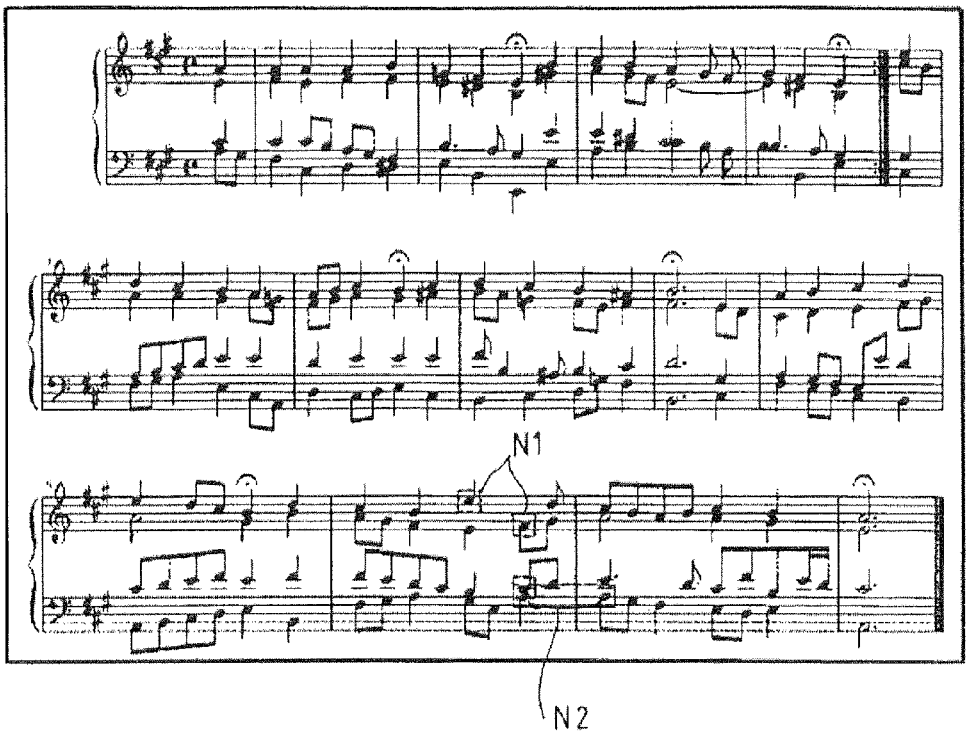
FIG. 3 illustrates a possibility according to embodiments of the invention of processing polymelodies of the BWV347 choral by J.S. BACH.

A first exemplary use of the system according to embodiments of the invention will be described with reference to FIG. 3. This figure is an extract of the device viewing screen, showing the possibility of processing polymelodies, here on choral BWV 347 by J.S. Bach. The notes surrounded by an unbroken square must be heard simultaneously and have start and end temporal indices that are all different from one another. The system makes it possible to interpret this musical passage in multiple ways. Three possibilities will be described hereinafter.

The first is a scheme of intermediate difficulty. It is a first fairly easy approach which is, however, already expressively rich. It comprises playing consecutively, with the help of an actuator A1, the two notes surrounded by the unbroken frame and, with the help of the actuator A2, the two notes surrounded by broken lines and in leaving the system to apply at the exact instants as a function of the speed VI the desirable note stoppages.

Accordingly, the events EM triggering the notes surrounded by an unbroken frame, and hereinafter called notes N1, are coded as AS1, but the stoppages corresponding to these notes are not associated with any action in the memory MA. The system then handles them by way of the sequences generated by GST1. The triggering of the notes surrounded by broken lines, hereinafter called notes N2, is for its part coded as AS. Thus the system handles the stopping of these notes, while according priority, however, to the execution speed determined on the basis of the actuator A1. If the person, to train himself for example, desires to play only the notes N2, the system will utilize the sequences generated by GST2 to play the events that are not associated with an action, for example the stopping of the notes.

A second, easier, possibility of interpretation comprises playing only the notes N1, the system handling not only the notes N2 but also all the required stoppages of notes. In this case, the triggering of the notes N2 is no longer associated with an actuator, but this triggering is coded so as not to be filtered while playing the sequences GST1. The actions for triggering the notes N1 will then alone suffice to correctly generate the triggering of the notes N2 as well as the end of all the notes.

A third possibility is the richest in terms of expressivity but requires greater skill from the user. Nonetheless, this approach is much more accessible than traditional playing of such a passage, while offering strictly the same possibilities in terms of expressive richness. In this approach, the actuator A1, for example a zone of an electronic keyboard, will be used to trigger the notes N2. But A1 will also be used to control the stopping of these notes. A second actuator A2, for example another zone of a keyboard, will be used to control the triggering and stopping of the notes N2. Such a possibility requires a specialized unit within the system. The manner of operation of an embodiment of this unit is described in the following paragraph referring to FIG. 5.

Figure 5:
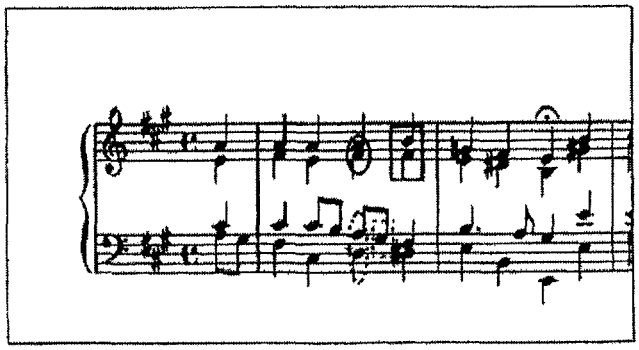
FIG. 5 illustrates a portion of a score to explain operation of the action memory MA according to embodiments of the invention.

In FIG. 5, presenting an extract of the piece already seen above, various notes have been framed as a function of the way in which they are processed by the system. The two notes framed by a continuous ellipse are for example synchronization events related to the actuator A1. They will be coded for example by the value 11144 at the head of the list of 8 values of the corresponding EM, the first 1 indicating synchronization, the second 1 the actuator 1, and the value 144 a note start on the MIDI channel 1. The two notes surrounded by the dotted ellipse are for example assigned to the actuator A2, but must not be used for synchronization. They will be for example coded by the value 2145, signifying an absence of synchronization, actuator 2, MIDI channel 2. The same holds for the note framed by a dotted rectangle.

If the user uses only one actuator, for example if he plays the right hand only, the events 11144 are played when there is action on A1. Moreover the tempo is calculated on the basis of the elapsed time between the last two synchronization actions AS received. The EMs 1144 are played and GST1 dispatches a sequence of temporal indices starting at the current temporal index and finishing just before the next expected synchronization action. Thus, the EMs 2145 will be played, namely immediately the notes surrounded by a dotted ellipse and, at the desired instant, the note encircled by a dotted rectangle. Next the system waits for an expected new action on A1. If this new expected action takes place before the note in the dotted rectangle is played, then the purge mechanism deletes this note which will not be played since the user has accelerated greatly.

If the user uses two actuators A1, A2, for example right hand and left hand, the receiving of the action A1 corresponding to the notes encircled by the continuous ellipse triggers the playing of these notes, but not the playing of the notes surrounded by the dotted ellipse. These notes will be played by the next action received on A2, unless the following action A1 intended for the note framed by the continuous rectangle occurs before. In this case, they will be omitted.

A second exemplary use of the system according to embodiments of the invention relates to the management of the note-offs and polymelodies.

Figure 4:
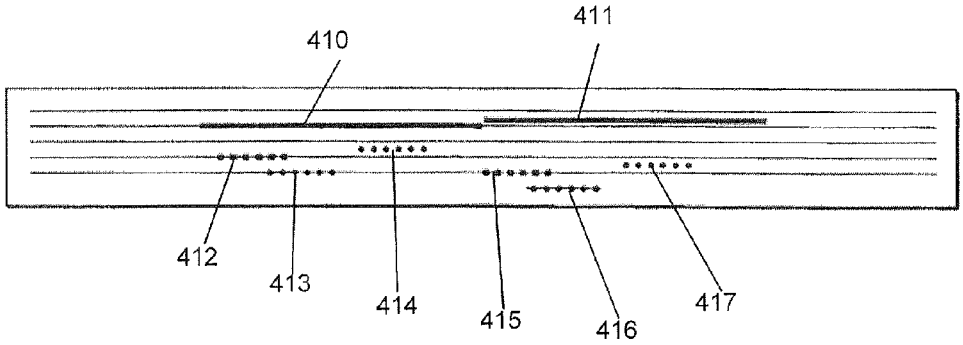
FIG. 4 illustrates exemplary polymelody processing according to embodiments of the invention.

For the explanation, a commonplace situation has been represented schematically on a musical span in FIG. 4, in which long notes (bold continuous; 410, 411) have to be held while shorter notes (bold dotted; 412, 413, 414, 415, 416, 417) are superimposed on them. When a note is played, the system maintains in a dedicated memory, termed the note-off memory, one being provided per actuator track, an identifier of the action used, typically the number from 1 to 127 of the MIDI note depressed on the keyboard, and against this identifier, the set of musical events EM that have been triggered during this action, such as type, pitch, force, end index and position on the screen of the played events. Upon the release of the actuator, the note-off memory is re-read at the address corresponding to the identifier received and the events contained at this address are modified so as to cause the stoppage of the notes or of a pedal information cue, which are triggered initially by the identifier. This technique makes it possible to associate so many polyphone pathways with different identifiers, and to trigger and halt them independently, even on the basis of a single actuator. The playing of several simultaneous melodies is thus achieved.

Figure 6:
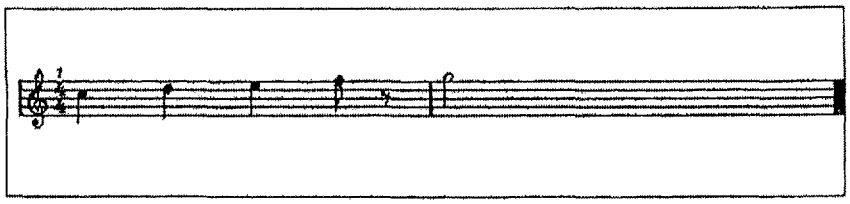
FIG. 6 illustrates operation of a mechanism for automatically stopping notes according to embodiments of the invention.

By way of illustration of the mechanism for stopping notes, a sequence of five notes "C D E F G" is given in FIG. 6. Table 3 reproduced hereinafter gives the content of the events memory for this sequence of notes:

TABLE 3

| | |
|---|---|
| 0 | 11144 72 127 384 x0 y0 x1 y1; |
| 384 | 1128 72 0 0 x0 y0 x1 y1 11144 74 127 384 x0 y0 x1 y1; |
| 768 | 1128 74 0 0 x0 y0 x1 y1 11144 76127 384 x0 y0 x1 y1; |
| 1152 | 1128 76 0 0 x0 y0 x1 y1 11144 77 127 192 x0 y0 x1 y1; |
| 1344 | 1128 77 0 0 x0 y0 x1 y1; |
| 1536 | 11144 79 127 768 x0 y0 x1 y1; |
| 2304 | 1128 79 0 0 x0 y0 x1 y1; |

The left column contains the instants indicated in terms of number of temporal resolution increments, at which the events take place. The temporal resolution is 384 increments per crotchet. The musical events EM are the groups of 8 consecutive values, in which x0, y0, x1, y0 designate the locations on the score. As was indicated above, while explaining table 1 of the memory MM, the first value of each row indicates the way in which the event is processed. Thus the value 11144 in the first row indicates a temporal synchronization event, expected by the actuator A1, the remainder 144 a note start on MIDI channel 1. The first value of 1128 of the second row will not be taken into account for the temporal synchronization since the division of 1128 by 10000 gives 0, but it concerns track 1 related to A1, since 1128/1000 gives 1. Finally, the remainder of the division 1128 by 1000 equals 128. The code in accordance with the MIDI standard indicates a note stoppage on MIDI channel 1. It should be noted that 129 would indicate a stoppage on MIDI channel 2 and so on and so forth up to 143 which would be a stoppage on channel 16. Thus at the instant 384 of the second row, the first EM designates the stopping of the note of pitch 72 which is the second item of the list of 8 values. It must be stressed that in a list of events EM, the EMs relating to a note stoppage should feature before the note-triggering EMs. Otherwise, a repeated note, that is to say one which is stopped and then re-triggered, will not be played correctly.

More precisely, described hereinafter is the sequence of operations performed on receipt of the action A1 triggering the fourth note F at the instant 1152: the first musical event EM is played, it entails the stopping of the note 76 (E). The second EM is played, it entails the triggering of the note 77 (F). The event EM corresponding to the latter note triggering is stored in the purge mechanism PU1 of track 1. The temporal resolution increment PRT=[t(1152)−t(768)]/(1152−768) is calculated, where t(768) represents the actual instant at which the event of temporal index 768 has been played, with a precision of the order of a millisecond (ms). The temporal sequence generator GST1 generates a sequence of (1536-1152-1)=382 values going from 1152 to 1535, at successive time intervals of PRT ms. This sequence addresses the musical memory MM of the musical events EM at intervals PRT. If nothing exists in the memory MM at the temporal index of interrogation, nothing happens. If one of the events EM features at a temporal index of interrogation, it is played. Thus, when the index 1344 is reached, it triggers the reading of the event EM registered in the memory at this index. If the automatic note stoppage system is activated on track 1, the EM of stoppage of the note F is dispatched. If it is not activated, the EM is filtered, that is to say ignored. Instead of this EM, the release of the key depressed on A1 which has triggered this F will be used to stop the note. In both cases, the corresponding note stoppage EM is removed from the purge mechanism PU1 of the track.

The sequence continues its progress: either until the instant 1535 is reached, where the next action A1 is expected, or if an action A1 is received before 1535 has been reached. In the case where the user is accelerating, GST1 is halted and the cycle described hereinabove recommences from the instant 1536. Finally, if the user has accelerated greatly, he could dispatch the action A1 for triggering the note of the instant 1536 before the sequence has reached the value 1344. We therefore skip directly to the event EM of the instant 1536, but the note stoppages stored in the purge mechanism whose dates are less than 1536 are played beforehand.

Described hereinabove, by way of example, is the manner of operation of the system according to embodiments of the invention for events EM stored in the memory MM at relatively sizable temporal index intervals. Of course, the system also makes it possible to play continuous data which have the particular feature of taking place at closely spaced temporal intervals, for example at each successive time increment. This may entail for example the volume control defined in the MIDI standard by a status lying between 176 and 191 for respective channels 1 to 16. In this case, the memory MM of the events EM will contain events in the identical form of 8 values. The first value could for example be 11176, that is to say defining a synchronization event on track 1 triggering a MIDI control. If the two values which follow are for example 7 and 100, complying with the MIDI standard, it would involve a volume control and the volume is set to 100. A first value 1176 or of 3176 would concern a non-synchronizing event concerning respectively track 1 and track 3.

In a manner identical to what is described above for note stoppages, the sequence of temporal indices that is triggered by the GST of a track will successively address the indices subsequent to which the so-called continuous data are stored, and these data will therefore be played at the current rhythm deduced from the user's playing.

Certain Specific Modes of Musical Playing

The system according to embodiments of the invention could comprise other characteristics so as to take better account of certain specifics of the musical playing. This involves the appropriate management of the note stoppages or note-offs and of the interpretation events which induce "locally", that is to say solely in respect of the event considered and optionally its immediate neighbors, variations with respect to the normal mode of processing of the events such as described hitherto.

Among these specifics will be cited, by way of example, the time window which has already been described above, and those specifics designated by the terms arpeggio, appoggiatura, mordent or gruppetto, accent or trill.

Concerning the term arpeggio, the latter leads to the notes concerned not being played as represented on the score, that is to say simultaneously, but in sequence. It is important to be able to control the temporal progress of the sequence. Upon the arpeggio indication coded in the type of the EM, the system performs the following operations: it reads the number of notes concerned, plays the first note encountered and reads the following notes only on the appearance of a new primary action. Next, it calculates the new temporal parameter on the basis of the primary action that played the first note of the arpeggio.

An action resulting in the playing of an appoggiatura is not subject to the time window. Two primary actions that are very close together in time are permitted locally, without consideration of the current speed VI.

The events EM whose type encodes a mordent or a gruppetto are followed by a series of numerical values indicating the shift in note pitch "offset" with respect to the main note. The notes calculated on the basis of these shifts are then played in a mode identical to the arpeggio mode.

The accent mode indicates modification of the playing force of the actuator concerned by the appended value, in general an additive offset. In practice, the accent information is coded within the velocity stored in the corresponding event EM.

An event EM whose type encodes a trill indicates the note pitch modulating the trill note, more often than not the main note plus a half-on or a whole beat. Several numerical values indicate a trill on several notes. The calculation of the current speed VI and the time window are deactivated for the duration of the trill which is suitable ad libitum. As long as the performer user alternately plays the same two controls on the actuator which causes the trill, the latter is prolonged. As soon as the performer activates a new control, for example depresses a third key on the keyboard, the trill exit note is played and the system resumes normal operation.

Other modes may be added, such as crescendo or decrescendo having a gradual effect on the playing force produced.

The system according to embodiments of the invention also provides for editing of the hierarchy of the events. In most cases, the events EM are associated from the very start with an actuator on the basis of MIDI channels assigned in general to the playing for example of the right hand (channel 1) and left hand (channel 2) in most MIDI musical data files. The system therefore automatically initializes the assignment of the events on the basis of these channels. In order to be able thereafter to alter the playing of the right and left hands, provision is made for functions for editing these assignments which are either global, for example to entrust the system with the control of all the left hand note stoppage events, or local by means of on-screen editing. Each event is displayed on the screen with a color code corresponding to the actuator to which it is assigned, as is shown in FIG. 2 where the framings of notes are not done by color but by continuous or broken lines. The user selects one or more events and modifies if necessary the actuator number allocated to it. This will result in a modification of the type of the event EM which is assigned to it in the memory MM.

In some embodiments, the invention also provides for the possibility of a keyboard with floating separation points. In a mode of use of embodiments of the system, a keyboard is used which is separated into two playing zones around a fixed point. Any note depressed to the right of the separation point will be for example an action A1 and any note depressed to the left of the same point will be an action A2. The fixity of the separation point may be the cause of playing errors and also restrain free expression. In order to remedy these drawbacks, embodiments of the invention provide several solutions, including dynamic assignment of actions as a function of temporal progress. In this case, the system knows, by considering the content of the memory MA for the temporal index of the next action, which events are preferably expected at a given instant. When the action in question arises, the system decides whether this entails an action A1 or A2 as a function of what is probable at the instant considered. If both types of action were expected at this instant, the system would choose to assign the actions A1 and A2 as a function of the respective position of the identifiers received, that is to say of the keyboard notes number. Another solution resides in resorting to an additional sensor such as an accelerometer placed on the mobile parts of the performer or performers, for example on the left and right handles. The system analyzes the simultaneity of the signals received from the play actuators and from the sensors which will display a signal spike when a key is depressed. The temporal agreement makes it possible to determine precisely which is the action source at any instant. Such a system would be highly useful as a supplement to traditional MIDI actuators, such as keyboards.

Although the invention has been shown and described above with respect to exemplary embodiments thereof, it should be understood by those skilled in the art that various changes, omissions, and additions may be made thereto, without departing from the spirit and scope of the invention.

The invention claimed is:

1. A system for computer-aided interpretation of a prerecorded music piece, comprising:

at least one actuator, said actuator being actionable by an interpreting artist user, a processor operatively connected to at least:

a first memory, wherein musical events are stored to aid interpretation by said interpreting artist user of said pre-recorded music piece, a sequence of said musical events being indexed by a first time index, said sequence representing said prerecorded music piece, and a second memory, wherein actions indexed by a second time index are stored, said actions having to be executed by said interpreting artist user to trigger said musical events, a group of software modules comprising code instructions to control said processor, and a device for producing audio signals from information at an output of said processor, under control of said at least one actuator, wherein said musical events are represented in said first memory by codes comprising at least a data characterizing at least an action stored in said second memory having to be executed to trigger said musical events.

2. The system of claim 1, wherein each first time index of the first memory is associated with at least one musical event, said musical event being defined between the beginning of said prerecorded music piece and said musical event, and wherein a unit of said first time index is a time resolution increment between the beginning of said prerecorded-music piece and said musical event, said increment being an integer multiple of an elementary time resolution characterizing a selected note.

3. The system of claim 1, wherein the at least one data of the code of a musical event characterizing at least an action stored in the first memory represents an action to be executed on an actuator, said action being chosen from the group of action types consisting of synchronizing, non-synchronizing and no-action types.

4. The system of claim 1, wherein said actions stored in said second memory contain, for each value of said second time index of said second memory which is equal to a value of a first time index of the first memory, at least one data coding a type of action to be executed on an actuator, said action being chosen from the group of types consisting of synchronizing, non-synchronizing and no-action types.

5. The system of claim 4, wherein the second memory further comprises an end time index representing an end of said action to be executed.

6. The system of claim 4, wherein the second memory further comprises a data representing a location of said musical event on a partition of said prerecorded-music piece.

7. The system of claim 1, wherein the group of software modules comprises, for each of said actuators, a time sequence generator which is programmed to be capable of reading in said second memory the type of actions to be executed for each second time index.

8. The system of claim 7, wherein the time sequence generator is programmed for ignoring an action of said actuator, when an action to be executed which is read in said second memory at the second time index is of the no-action type.

9. The system of claim 7, wherein the time sequence generator is programmed to trigger reading of the musical event corresponding to said actuator at equal values of the first and second time indexes in said first memory, and to have the musical event played by the device for producing audio signals, when the action to be executed which is read in said second memory at the second time index is of the non-synchronizing action type.

10. The system of claim 7, wherein said time sequence generator is programmed to calculate an instantaneous speed of execution of the prerecorded-music piece by the interpreting artist user and a number of time resolution increments until the next synchronizing action which is expected according to the second memory, and to generate a sequence of time indexes corresponding to said instantaneous speed of execution, when the action to be executed which is read in said second memory at the second time index is of the non-synchronizing type.

11. The system of claim 10, further comprising a purge module for at least one of the actuators, said purge module comprising an associated memory wherein are stored ongoing musical events with corresponding end time indexes, said purge module being programmed to read said associated memory and to stop musical events whose end time indexes are after a first time index which has been skipped, said read and stop actions being triggered when a variance of the instantaneous speed higher than a selected threshold is detected for said at least one actuator.

12. The system of claim 11, wherein, when the processor reads a first time index comprising an end time index of a musical event which is stored in the memory associated with the purge module, this musical event is executed and then stopped and erased from the memory associated with said purge module.

13. The system of anyone of claim 11, wherein said purge module of said at least one actuator is programmed to read its associated memory on receiving any new action from said actuator and, when detecting musical events the first and/or second time index of which is lower than the on-going action, said musical event is stopped and erased from the memory associated with said purge module.

14. The system of claim 1, further comprising a filtering module, said filtering module being programmed to authorize or forbid execution of a musical event, said execution being triggered by an action of an actuator or execution of an on-going time sequence.

15. The system of claim 14, wherein said filtering module comprises an interface whereby the interpreting artist user can program conditions for said authorizing and forbidding.

16. The system of claim 1, further comprising means for stopping notes in the pre-recorded music piece to enable playing of polymelodies comprising simultaneous melodies.

17. The system of claim 1, further comprising a keyboard separation mechanism with a floating function that allocates functions to keys on the keyboard based on a value of the first time index in the first memory.

* * * * *